US007318294B2

(12) United States Patent
Zimmermann

(10) Patent No.: US 7,318,294 B2
(45) Date of Patent: Jan. 15, 2008

(54) MAGAZINE FOR RIFLES AND HANDGUNS

(76) Inventor: Alex Wulff Zimmermann, 171 Madison 1510, Huntsville, AR (US) 72740

( * ) Notice: Subject to any disclaimer, the term of this patent is extended or adjusted under 35 U.S.C. 154(b) by 0 days.

(21) Appl. No.: 11/378,012

(22) Filed: Mar. 16, 2006

(65) Prior Publication Data

US 2006/0272192 A1 Dec. 7, 2006

Related U.S. Application Data

(62) Division of application No. 11/001,960, filed on Dec. 2, 2004, now Pat. No. 7,047,686.

(60) Provisional application No. 60/530,396, filed on Dec. 16, 2003.

(51) Int. Cl.
*F41A 9/67* (2006.01)

(52) U.S. Cl. ..... 42/7; 42/50

(58) Field of Classification Search ..... 42/7, 42/49.01, 50, 106, 70.02; 89/34, 197, 195, 89/33.1

See application file for complete search history.

(56) References Cited

U.S. PATENT DOCUMENTS 3,019,542 A * 2/1962 Manthos ..... 42/18
3,241,449 A 3/1966 Dwyer, Sr.
5,099,595 A * 3/1992 Chesnut et al. ..... 42/50
5,153,359 A * 10/1992 Lishness ..... 42/50
5,287,720 A * 2/1994 Lishness ..... 72/379.2
5,533,291 A * 7/1996 Boland ..... 42/7
5,566,487 A * 10/1996 Vaid et al. ..... 42/7
5,615,505 A * 4/1997 Vaid ..... 42/50
5,638,626 A * 6/1997 Westrom ..... 42/50
6,055,758 A * 5/2000 Vieweg ..... 42/7
6,094,850 A * 8/2000 Villani ..... 42/1.02
6,622,610 B2 9/2003 Adkins
6,761,102 B2 7/2004 Giza
6,931,978 B1 8/2005 Dionne
2005/0229459 A1* 10/2005 McGarry ..... 42/7

OTHER PUBLICATIONS

Integrated Systems Management. http://www.ismi-gunsprings.com/magazine_ar15.html. Apr. 17, 2003 from www.waybackmachine.org, Reference B, 2 pages.*

RCBS.Load Cartridge Designer Utility. http://www.gmdr.com/rcbs/rcbstext9.htm. Jan. 14, 2003 from www.waybackmachine.org, Reference A, 5 pages.*

* cited by examiner

*Primary Examiner*—Michael J. Carone
*Assistant Examiner*—Stewart T Knox
(74) *Attorney, Agent, or Firm*—Brinks Hofer Gilson & Lione; Joel W. Benson

(57) ABSTRACT

An improved magazine has crimped feed lips which feed rebated rim cartridges into a handgun or rifle without nose-diving. The magazine has a metal-reinforced follower which extends the operational life of the magazine.

21 Claims, 8 Drawing Sheets

MAGAZINE FOR RIFLES AND HANDGUNS

RELATED APPLICATIONS

Reference To Prior Applications: This is a divisional application of and claims priority to U.S. patent application Ser. No. 11/001,960, filed Dec. 2, 2004 now U.S. Pat. No. 7,047,686, and entitled: Versatile M1911-Style Handgun and Improved Magazine for Rifles and Handguns, which is incorporated herein by reference. The present nonprovisional divisional patent application claims the benefit of the filing date under 35 U.S.C. § 119(c) of Provisional U.S. Patent Application Ser. No. 60/530,396, filed Dec. 16, 2003, which is hereby incorporated by reference.

BACKGROUND

1. Technical Field

This invention concerns an improved magazine for handguns and rifles, and more particularly to such an improved magazine with enhanced cartridge feeding characteristics and operational reliability.

2. Background Information

The M1911-style handgun was initially developed and commercialized by John Browning in the year 1911. This handgun employed a then-novel mechanism for firing in a semiautomatic fashion substantially large cartridges of .45 caliber, for example .45 ACP (Automatic Colt Pistol) cartridges. This handgun is sometimes referenced as the Government Model 1911 and was for many years favored for use in the U.S. military and served as a hand weapon for U.S. soldiers in the World Wars. This weapon is still favored for personal defense, because it is capable of shooting a relatively large bullet which has substantial "stopping power" when used against animals or humans.

In operation of the M1911-style handgun, there is considerable recoil and the muzzle of the handgun tends to flip up when the gun is fired. Recoil is herein defined as the shock and pressure transmitted by the gun to the hand when the gun is fired and muzzle flip is the tendency of the muzzle of the gun to rise out of alignment with a target when the gun is fired. It is known that the degree of perceived recoil and muzzle flip are to a large extent a function of the combined mass of the barrel and slide of the gun, which move in a characteristic linear reciprocating manner when the gun is fired.

In operation of the M1911-style handgun, the barrel and slide are mechanically engaged and initially move together about0.125 inch (0.318 cm) toward the shooter in reaction to the discharge of a cartridge and, after movement together over this distance, the barrel is then automatically pulled down by a well known mechanical link and is physically disconnected from the slide. The barrel is then stopped when its back end engages the frame of the gun, and the slide continues to move backwards toward the shooter in reaction to the force of the shot. The slide moves toward the shooter against the force of a return spring which is fully compressed when the slide reaches its furthest rearward position with respect to the shooter.

As the slide moves back toward the shooter, a known extractor mechanism pulls the cartridge case out of the barrel chamber and a known ejector mechanism in the gun engages a rim formed at the rear of the case of the ammunition cartridge and expels the empty case from the body of the gun. Of course, the case of the cartridge is empty, because it has previously been fired and the bullet has been expelled from the case and has passed down the barrel of the gun toward a target. After ejecting the spent case, the slide reaches its rearmost position and, under the force of the return spring, slides forward to its front stationary position.

As the slide moves forward, a known breech face within the gun strips the next successive cartridge from the top of a magazine that holds a number of cartridges under the pressure of a magazine spring within the magazine. The fresh cartridge is fed into the barrel chamber of the gun in a position from which it is fired when a trigger of the gun is pulled.

One disadvantage of current M1911-style magazines is that the nose of a cartridge sometimes will drop or dive as the cartridge is fed into the breech of the gun, and the cartridge can therefore become jammed. An improved magazine for avoiding this problem would therefore be desirable and is disclosed herein. The slide, barrel, and cartridge extracting and ejecting mechanisms operate in the described known manner to automatically remove spent cartridge cases and load fresh cartridges in response to successive pulls of the trigger, until the magazine is empty, at which point the slide is held in an open battery position, awaiting the next loaded magazine.

When the pistol fires, a large amount of the developed energy is transformed into kinetic energy of the slide and barrel. This energy is then further transferred to the frame of the pistol and the hand holding the frame, as the slide and barrel hit the frame at their rearward stop positions. The combined mass of the barrel and slide hitting the frame of the gun causes the recoil that is felt in the hand holding the gun. The recoil also tends to jerk up the muzzle of the barrel from its aligned position with respect to a target. The recoil resulting from the firing of a .45 ACP cartridge can therefore cause some discomfort to the hand of the shooter and it will also be necessary for the shooter to realign the muzzle of the gun with the target after each shot. The relatively substantial recoil and muzzle flip associated with M1911-style handguns has been a significant drawback in the use of such guns, but the desirable results achieved by a relatively large .45 caliber bullet has maintained the popularity of the M1911-style gun for self-defense for nearly a century.

Although the appearance and function of the M1911-style handgun have been favored by many shooters over considerable time, there have been attempts to reduce the perceived recoil and muzzle flip when the gun is fired. For example, it has been proposed to form or attach a weight to the muzzle of the barrel to increase the mass of the barrel and also reduce muzzle flip in response to the discharge of a .45 caliber cartridge. It has therefore been recognized that increasing the mass of the barrel, particularly at the muzzle, will result in a decrease in perceived recoil and muzzle flip. It has also been suggested that reducing the relative mass of the slide will reduce perceived recoil, because a lighter slide reciprocating above the hand holding the gun will have reduced momentum and therefore less recoil. It has therefore been suggested that slots or other cutouts can be made in the standard M1911-style slide to remove material and therefore reduce the mass of the slide and associated recoil.

The heretofore proposed design changes for reducing perceived recoil and muzzle flip would necessarily require substantial cosmetic changes in the appearance of a M1911-style gun. However, a change in the appearance of the venerable, near century old handgun design has not been favored. Accordingly, M1911-style guns with the classic appearance and traditional slide and barrel masses are still produced in substantial quantities by many large firearm manufacturers.

Another reason for continuing the use of the classic M1911 design is that the total combined masses of the barrel and slide have been optimized to operate with a .45 caliber cartridge, and this optimized implementation of these large reciprocating masses has been adopted and continued over the years, despite the negative issues associated with perceived recoil and muzzle flip. However, it has long been felt that it would be desirable to retain the classic design and appearance of the M1911-style handgun, but alter the internal mechanism in some way to reduce perceived recoil and muzzle flip with use of the .45 ACP cartridge. No one has heretofore been able to achieve this result.

In recent years it has been recognized that the stopping power of a handgun is enhanced by use of cartridges of greater size and weight than the .45 ACP cartridge. Accordingly, revolvers and semiautomatic pistols have been developed to fire larger .50 caliber cartridges, which form a relatively large wound channel and therefore have substantially increased stopping power. For example, the DESERT EAGLES® semi-automatic pistol developed by Israel Military Industries Ltd., shoots a .50 caliber cartridge that is thicker and much longer than a .45 ACP cartridge. This .50 caliber pistol has a design that is substantially different than the design of the M1911-style handgun, and it is very large and very heavy in comparison. The .50 caliber DESERT EAGLES® pistol also has a very substantial recoil greatly in excess of what would be expected from a standard M1911-style handgun, and its large size and substantial weight make it difficult for many people to carry or use it for self-defense. Other pistols have also been developed to shoot .50 caliber bullets, for example in revolver-style mechanisms, again with substantial size, weight and recoil penalties.

It would therefore be desirable to provide a practical design for a M1911-style handgun that will allow the gun to shoot novel .50 caliber ammunition with a recoil and muzzle flip no greater than is typically associated with a .45 caliber M1911-style gun, and without changing the exterior appearance or weight of the gun.

It would also be advantageous to provide such a design for a M1911 handgun that would easily accommodate .50 caliber or .45 caliber cartridges and smaller .40 S&W, 9 mm or .38 Super cartridges, with associated substantial reductions in recoil and muzzle flip.

It would also be advantageous to utilize in a M1911-style handgun, a .50 caliber cartridge with a rebated base rim, for example as is used in rifles and in the DESERT EAGLE® pistol, so that .50 caliber ammunition can be used in the M1911-style handgun, without changing the .45 ACP caliber firing, extraction and ejector mechanisms that are typically used in the handgun. It would also be advantageous to provide .50 caliber cartridge cases with .45 ACP caliber-sized base rims and smaller diameter bullets, such as 9 mm, 0.38, 0.40 and 0.45 diameter bullets, so that the cartridges having such smaller bullets could also be used with the internal cartridge-handling mechanisms of a typical .45 ACP caliber M1911-style handgun.

It would also be desirable to provide an improved M1911-style handgun wherein the mass of a bull barrel used with the handgun is increased by thickening the wall of the barrel, and the mass of the associated slide is correspondingly decreased, from the inside of the slide, by routing out and thinning the walls of the slide to, in effect, redistribute mass from the slide to the barrel, in order to reduce perceived recoil and muzzle flip for any cartridge that is used, including a .50 caliber cartridge.

Finally, it would be desirable to provide magazines that will accommodate .50 caliber and smaller caliber cartridges for M1911-style handguns, and will reduce or eliminate nose-dive of rebated rim cartridges of any caliber for any firearms, including handguns and rifles of any type, which operate with rebated rim cartridges.

BRIEF SUMMARY

The invention concerns an improved M1911-style handgun which operates with reduced recoil and muzzle flip, and which can use .50 caliber and smaller calibers of ammunition, by only changing the barrel and ammunition magazine for the gun. The invention also concerns a novel .50 caliber cartridge and an improved magazine for this and other smaller caliber cartridges which has an increased life and reduces or eliminates nose-diving of rebated rim cartridges of any caliber as they are fed into any firearm, for example any type of handgun or rifle that uses such cartridges.

Reduced recoil and muzzle flip are achieved by redistributing the mass of the barrel and slide of a typical M1911-style handgun. Thus, a bull barrel or other suitable relatively massive barrel of relatively increased diameter is used to provide increased mass. This increased mass will necessarily result in reduced recoil and muzzle flip for the gun. The increased diameter of the barrel is accommodated within a standard M1911 slide by routing and thinning the walls of the slide, from the inside, until the barrel fits within the slide in the usual manner.

In routing out the slide, typical locking lug grooves are reformed in the thinner walls of the slide to accommodate and engage associated lugs formed in the barrel in the usual manner. As a result, the barrel and slide operate as required for the typical M1911 design, but the increased mass of the barrel and relatively decreased mass of the slide result in reduced perceived recoil and muzzle flip when the handgun is fired. In effect, the total mass of the barrel and slide is redistributed, with favorable operational results.

The reduced recoil and muzzle flip are achieved without altering the exterior of the modified M1911 handgun in any respect, or substantially altering the weight of the handgun. Accordingly, the improved handgun has exactly the same appearance as a classic M1911-style gun, and enjoys a significantly reduced recoil and muzzle flip for .45 caliber cartridges or for whatever other caliber cartridges are handled by the gun, if the barrel is bored to accommodate any such cartridges.

In a further aspect of the invention, the relatively large diameter barrel of the improved handgun can have a larger bore and chamber that will accommodate true .50 caliber cartridges with case diameters from about 0.520 to 0.535 inch (1.32 cm to 1.359 cm) in diameter. Even with the larger bore for .50 caliber cartridges, the relatively massive barrel has sufficient mass to reduce recoil and muzzle flip to roughly what would be experienced by use of a classic M1911-style gun operating with .45 caliber ammunition.

The massive barrel of the improved handgun could also have a relatively smaller bore to accommodate .40 S&W, 9 mm, .38 Super or .45 caliber ammunition. If smaller caliber ammunition is used, the associated increased mass of the barrel will result in additional decreases in perceived recoil and muzzle flip. For example, with .45 caliber ammunition, the recoil and muzzle flip of the improved handgun will be less than has heretofore been experienced with M1911-style .45 caliber handguns of classic design.

The improved M1911-style handgun retains the firing and cartridge extraction and ejector mechanisms that are typically used for .45 caliber M1911-style guns. An improved operation with internal .45 caliber mechanisms is achieved for a .50 caliber cartridge, by forming a base rim on the cartridge that is the same diameter as the base rim for a typical smaller .45 ACP caliber cartridge. Thus, the base rim on the .50 caliber cartridge is "rebated" (i.e., reduced in size) so that the .50 caliber cartridge can be fired and handled in the same manner as a .45 ACP caliber cartridge with exactly the same cartridge handling mechanism in the M1911-style handgun. Of course, the .45 ACP cartridge will also be handled with the .45 caliber firing, extraction and ejector mechanisms within the gun.

The improved M1911-style handgun has a magazine which retains up to .50 caliber cartridges. This magazine is dimensioned with a greater thickness than a typical M1911-style magazine, in order to accommodate thicker .50 caliber cartridges. However, the length and width of the magazine do not change with respect to the length and width of a .45 caliber magazine for a typical M1911-style gun. The length and width dimensions of the magazine stay the same, so that the magazine can be engaged within the magazine well of a M1911-style gun, without changing the external width or length of the grip portion of the gun. Again, the improved operation with .50 caliber ammunition is achieved without changing the external dimensions of the M1911 handgun.

The increased thickness of the magazine is accommodated within the magazine well of the grip portion of the frame by internally machining and thinning the walls of the magazine well. It has been found that the inside dimensions of the magazine well of the gun may therefore be increased to accommodate the extra thickness of the magazine, while maintaining sufficient strength and integrity for the walls that form the well.

Special .50 caliber cartridges of approximately the same length as a .45 caliber cartridge, but with increased diameter, fit within the magazine and are dispensed into the gun in the usual manner. These cartridges are substantially shorter than other known .50 caliber cartridges, but are nevertheless capable of firing with enough force to travel with a muzzle velocity of about 600 to 1000 fps, depending on the propellant loads of the cartridges. This velocity is adequate for target shooting, hunting and self-defense.

Another aspect of the invention concerns forming feed lips by crimping the top-rear of the magazine, so that the rebated base rim of a .50 caliber or any other caliber rebated rim cartridge is retained and aligned to prevent nose-diving of the cartridge as it is extracted from the magazine. The crimped feed lips maintain the rebated rim cartridge in alignment during an initial relatively short portion of linear movement of the cartridge as it is stripped from the top of the magazine. Elimination of the nose-diving of the rebated rim cartridge during the feed-cycle reduces the incidence of jamming of such cartridges within the gun. Magazines of this design may be used to avoid nose-diving of rebated rim cartridges for any type of firearm, including handguns and rifles. So this improved magazine of the invention is not limited to use with M1911-style handguns.

A further aspect of the invention concerns providing a metal insert, for example in the form of a screw head or a molded-in piece of metal, at an indented opening of a polymer follower of the magazine. The metal insert reduces the wear in the indented portion of the follower which would otherwise occur when a slide-blocking element within the handgun engages the indentation in operation of the gun, to maintain the slide of the gun in an open orientation after the last cartridge is fired. The improved magazine of the invention therefore reduces or eliminates undesirable nose-diving of rebated rim cartridges as they are fed into the gun and also enhances the life of the follower portion of the magazine, and therefore increases the operational life of the magazine. A magazine of this design could be used with the stated favorable results for rebated rim cartridges of any caliber.

Another aspect of the invention concerns a series of novel cartridges with the same case (body) diameter as the special .50 caliber cartridge and having the same rebated .45 ACP base rim as previously described, but necked-down (i.e., reduced in diameter) at the mouth of the case to receive smaller caliber bullets. Such cartridges, with bullets of 9 mm, .38, .40 and .45 caliber, for example, will have increased internal capacity and can thus contain a heavier powder charge than would be typical for smaller cartridges of known designs. The special cartridges will therefore have substantially more power than has heretofore been known for cartridges of the same caliber. Also, the improved, more powerful cartridges can all be shot from the pistol of the invention, by simply switching the barrel of the pistol to accommodate the caliber of the bullet for the cartridge. The previously described bull barrel and reduced-mass slide, with a .45 ACP breech face and related .45 ACP mechanisms make this simple caliber change possible. The magazine will remain the same basic .50 caliber magazine which has pinched feed lips that guide the .45 ACP base rim of the case for all the different calibers of bullets.

Although the improved magazine of the invention can accommodate .50 caliber cartridge cases with rebated .45 ACP rims and .50 or smaller caliber bullets as previously explained, it can also be easily modified to retain and dispense .45 ACP cartridges or other lesser caliber cartridges without rebated rims, by forming the edges of the feed lips of the magazine to press against the cases of such cartridges, which are then retained in alignment as they are stripped from the top of the magazine in the usual manner. Thus, the improved M1191-style handgun according to the invention will operate with the same size magazine for all of the various different size cartridges that can be accommodated by the magazine. Accordingly, changes in the caliber of bullets with .50 caliber cases and .45 ACP caliber base rims, or with .45 or other caliber cases without rebated rims, may be achieved by merely replacing the relatively massive barrel of the handgun with the same size barrel having a bore that matches the selected caliber of the bullet, and using the large-sized magazine for the gun with associated crimps of the feed lips to accommodate the desired caliber cartridge.

The improved M1911-style handgun according to the invention is therefore versatile in that it can be easily modified to accommodate different calibers of ammunition, up to and including a .50 caliber cartridge, with reduced recoil and muzzle flip, and without changing the external appearance or weight of the gun. The improved handgun can therefore be used with available M1911-style holsters or other parts, for example gun sights, grip panels, mainspring housings, safety mechanisms, or other parts such as hammers, sears, magazine buttons or slide release levers which are available for standard M1911-style handguns. All favorable features are achieved without changing the classic appearance, weight, or any significant mechanical operation of the gun as originally designed by John Browning and as implemented for nearly a century.

DETAILED DESCRIPTION OF THE DRAWINGS AND THE PRESENTLY PREFERRED EMBODIMENTS

Figure 1:
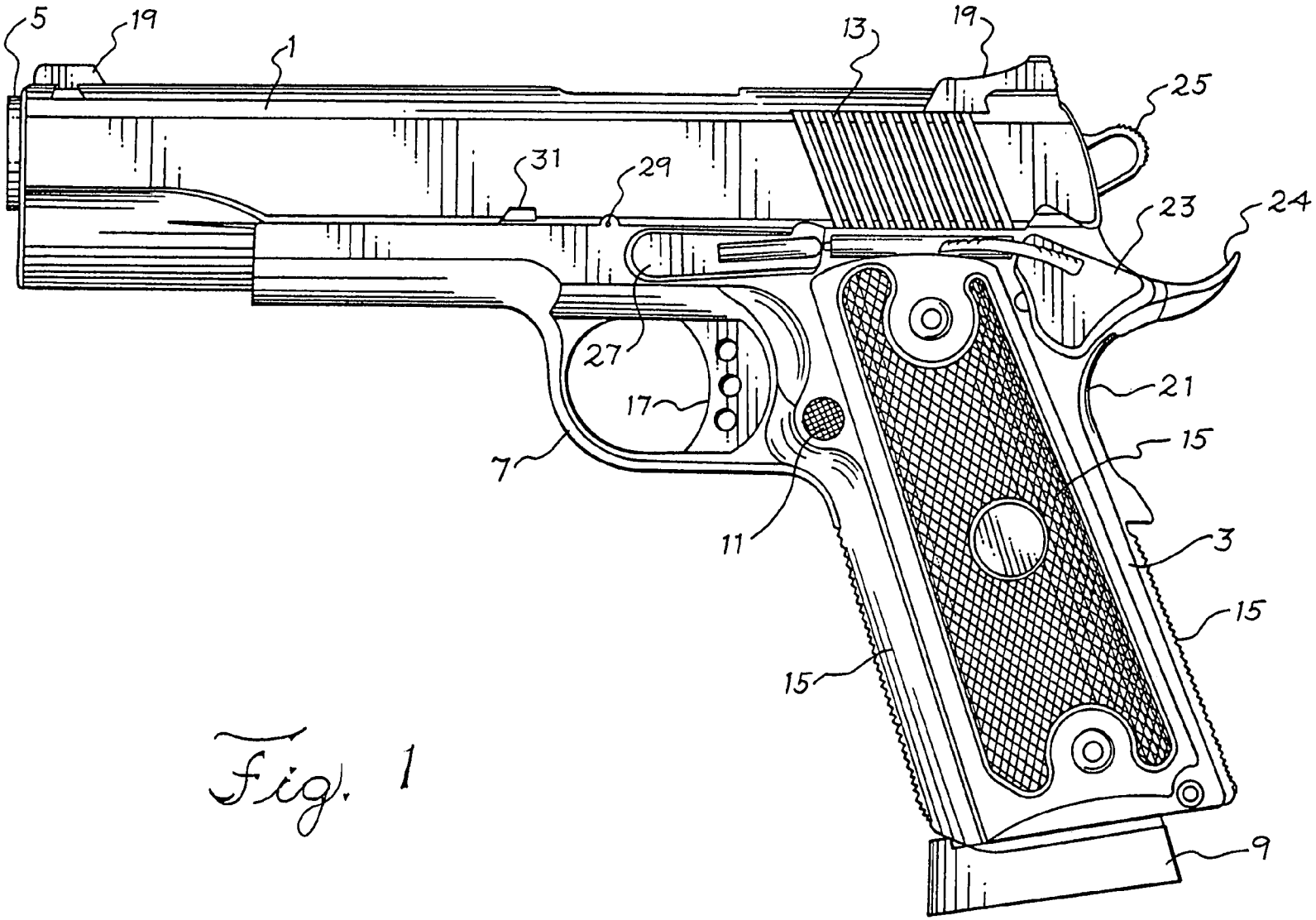
FIG. 1 is a side view of an assembled M1911-style handgun in accordance with the invention.

FIG. 1 illustrates a side view of a short recoil locked breech M1911-style handgun in accordance with the invention. The exterior of this gun is conventional in that it has the classic appearance of a M1911-style semi-automatic pistol as developed by John Browning about 93 years ago, with some modern external touches. Thus, the pistol of FIG. 1 has a traditional slide 1, grip housing 3, barrel 5, trigger guard 7, engaged magazine 9, magazine release button 11, slide grip serrations 13 and 20 lpi checkering 15 on the frame.

The gun also includes more modern external features such as a skeletonized aluminum trigger 17, modern sights 19, for example Heinie SlantPro tritium night sights, a grip safety 21, a manual safety 23, a beavertail extension 24, and a serrated skeletonized hammer 25 and sear (not shown) made of machined tool steel. Major components of the gun are held together by a traditional slide release lever 27 which will release the components when aligned with a release opening 29 of classic orientation and dimensions. A traditional slide lock-back notch 31 is also provided to engage the lever 27 when the gun is unloaded with the slide 1 in its open battery position. Pressing the lever 27 in this situation releases the slide so that it returns to its forward rest position. A lanyard pin (not shown) is provided in association with an opening in the grip housing to allow a strap (not shown) to engage the handgun.

Figures 2A, 2B:
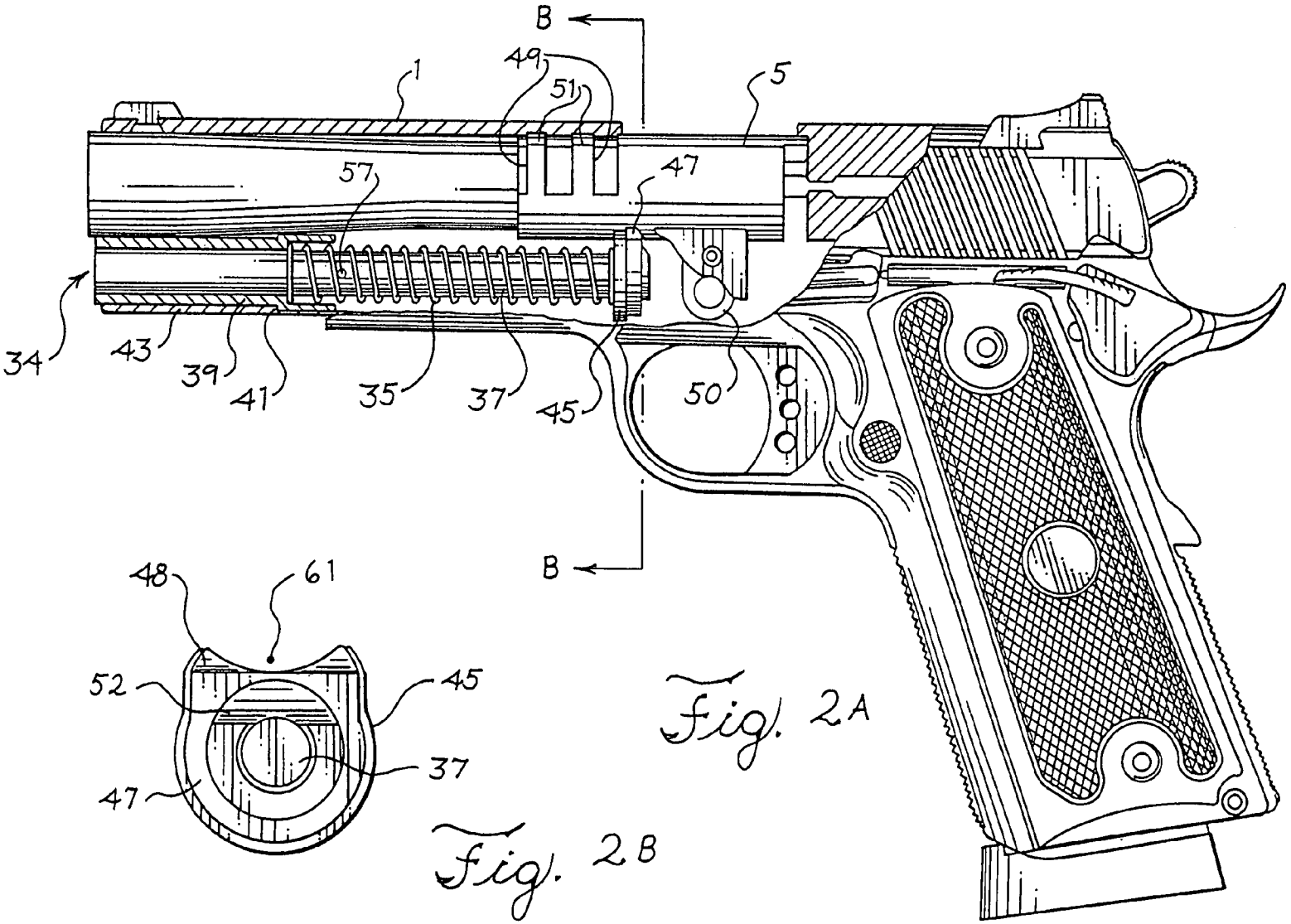
FIG. 2A is a partial cross-sectional side view of the assembled handgun of FIG. 1.
FIG. 2B is an end view of a return spring assembly, as viewed in the direction of the line B-B shown in FIG. 2A.

All of the referenced external parts of the handgun are well-known in the art of handgun design and are typically used for modem M1911-style handguns. FIG. 2A illustrates the handgun of FIG. 1, in partial section, which shows the engagement of the barrel 5 with the slide 1 of the gun. An internal return spring assembly 34 is shown with a spring 35, for example a 22 lb. recoil spring available from W.C. Wolff Co. of Newtown Square, Pa., mounted on a full-length guide rod 37 which abuts an internal reverse spring plug 39 that is retained against a shoulder 41 formed in the interior surface of a spring plug housing portion 43 of the slide 1. The back end of the spring 35 abuts a shock buffer 45 which is made of resilient material, for example an elastomer. A metal recoil guide rod head 47 is affixed to the end of the guide rod 37 in a conventional manner, for example by swaging, and holds the shock buffer 45 in position and the spring 35 in an extended orientation when the slide 1 is at a rest position shown in FIGS. 1 and 2A. As shown in FIG. 2B, the guide rod head 47 and shock buffer 45 are trimmed at area 61 to provide clearance with the barrel, and the top of the guide rod head may be filed in areas 48, 52 to provide additional clearance.

Most M1911-style handguns have a barrel bushing (not shown) which is retained in a locking engagement with the muzzle end of the slide. This barrel bushing keeps a spring plug captive and retains the recoil (return) spring within the slide of the pistol. It should be understood that the handgun illustrated in FIGS. 1 and 2A has an internal shoulder 41 and reverse spring plug 39 which are used to retain the spring 35 within the body of the gun. Either the reverse spring plug or a spring plug kept in place by a barrel bushing can be used to retain the return spring and its associated guide rod in place, without altering any aspect of inventions disclosed herein. The internal reverse spring plug 39 illustrated in FIGS. 1, 2A and 2B is therefore intended to be illustrative, and does not exclude the use of handgun designs which use a barrel bushing.

The barrel 5 is about 5 inches (12.7 cm) in length and is typically referenced as a "bull barrel," because it has a wider diameter at its muzzle and its back end adjacent the chamber, and a reduced diameter central portion. The barrel also has a conventional tapered cone shape. Other types of relatively massive barrels could be used at any desired lengths, without departing from the invention. The bull barrel 5 of FIG. 2 adds significantly to the mass of the handgun and provides an associated reduced recoil and muzzle flip when the gun is fired. As shown in FIG. 2A, lugs 49 are formed in the surface of the barrel 5 and are engaged with corresponding grooves 51 that are formed in the inside surface of the slide 1. The lugs and grooves mechanically interconnect the barrel and slide when they are at the rest position illustrated in FIGS. 1 and 2A. The interconnection of lugs and grooves between the barrel and slide is well-known in the art of handgun design, particularly with respect to the M1911-style handgun.

Figure 3:
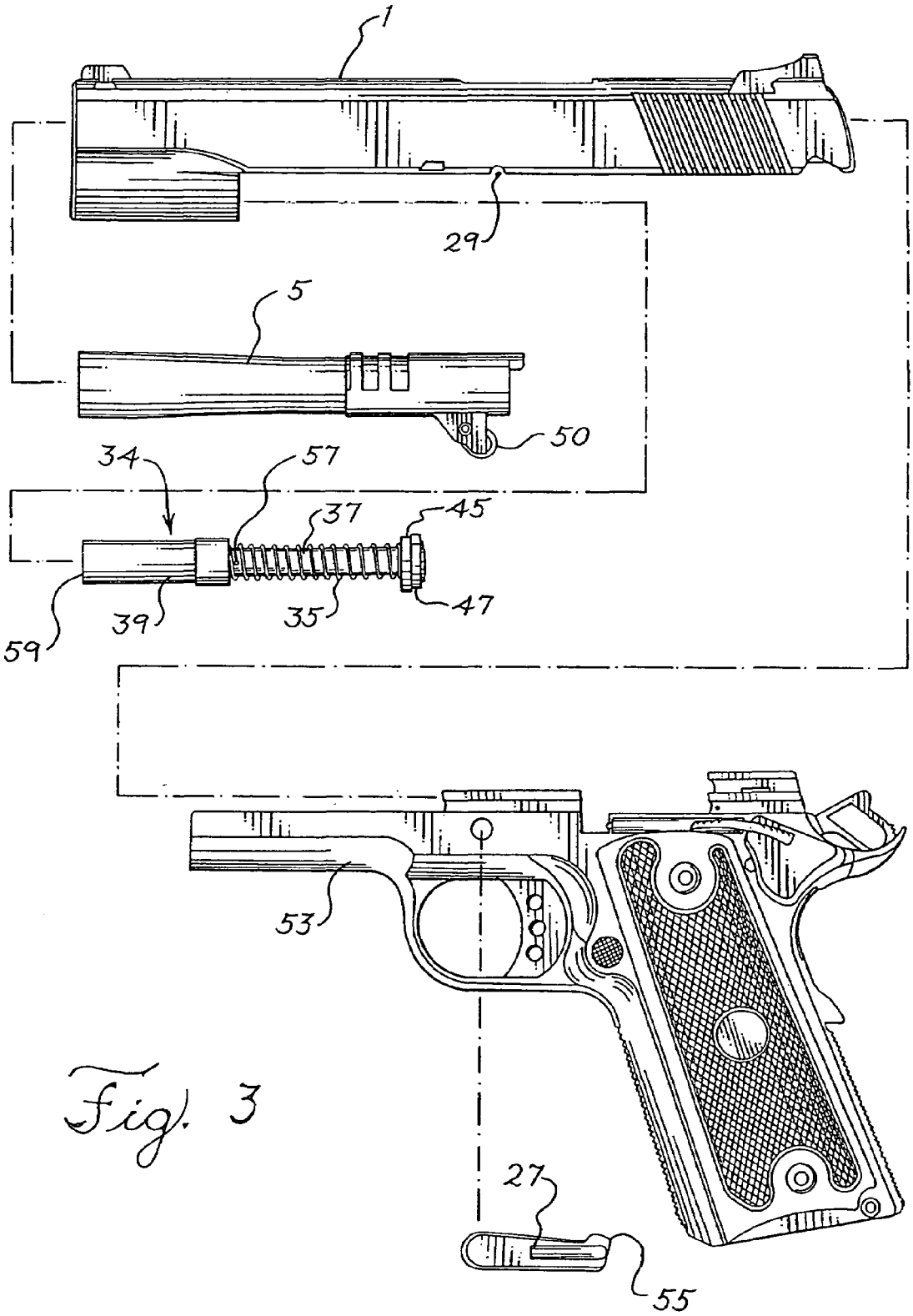
FIG. 3 is a side perspective exploded view of a M1911-style handgun in accordance with the invention, with the magazine disengaged.

FIG. 3 illustrates an exploded side perspective view of the handgun of FIGS. 1 and 2A. As shown in FIG. 3, the frame 53, made of, for example, a heat-treated steel forging and covered with a protective coating, for example by Parkerizing, is disassembled from the return spring assembly 34, the bull barrel 5, and the slide 1. The slide 1 may also be made of a heat-treated forging that is Parkerized. The parts are disengaged by forcing the slide 1 back until the release opening 29 is aligned with the half-moon shaped lug 55 on the known slide release lever 27. The lever 27 is removed and disconnected from the gun, and the slide is thereafter moved forward to disengage the slide from the frame 53. At this point the slide 1 will contain the bull barrel 5 and return spring assembly 34. As is well-known in the art, the recoil guide rod head 47 may be pressed to compress the spring 35 until a hole 57 in the guide rod 37 is exposed at the front end 59 of the reverse spring plug 39. A small metal pin (not shown) is then inserted into the hole 57 to provide an interference fit with respect to the end 59 of the reverse spring plug 39. The pin therefore holds the spring 35 in a compressed relationship with respect to the reverse spring plug 39. The return spring assembly 34 can then be removed from the slide 1, and the bull barrel 5 can also be removed to place the parts in the disengaged orientation illustrated in FIG. 3.

For completeness of illustration, an end view of the guide rod assembly is illustrated in FIG. 2B to show the relative shapes of the elastomeric shock buffer 45 and its associated recoil guide rod head 47. As previously noted, the shock buffer and guide rod head have a curved edge at 61 which is provided for clearance with respect to the bull barrel 5, so that the spring 35 can compress and extend without interference from the bull barrel. As is known in the art, the shock buffer 45 is provided to absorb the impact of reciprocating movements of the spring assembly when the gun is fired.

Figure 4:
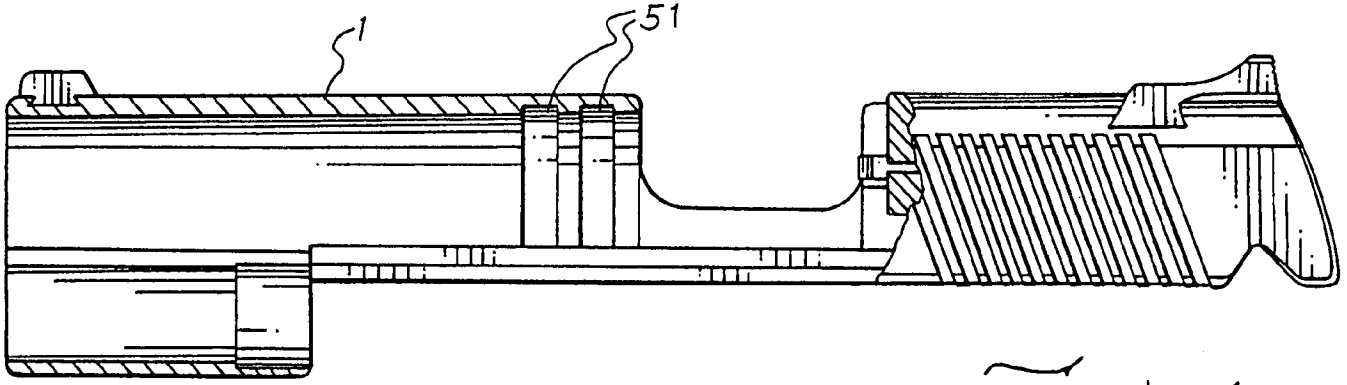
FIG. 4 is a partial sectional side view of the slide of the handgun of FIG. 1 in accordance with the invention.
Figure 5:
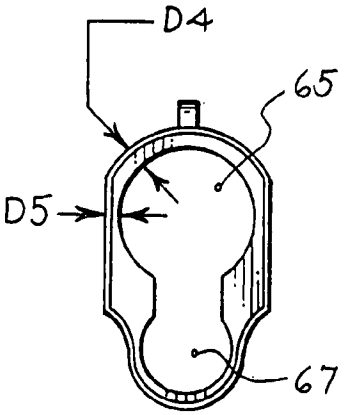
FIG. 5 is an end view of the slide of FIG. 4.
Figure 6:
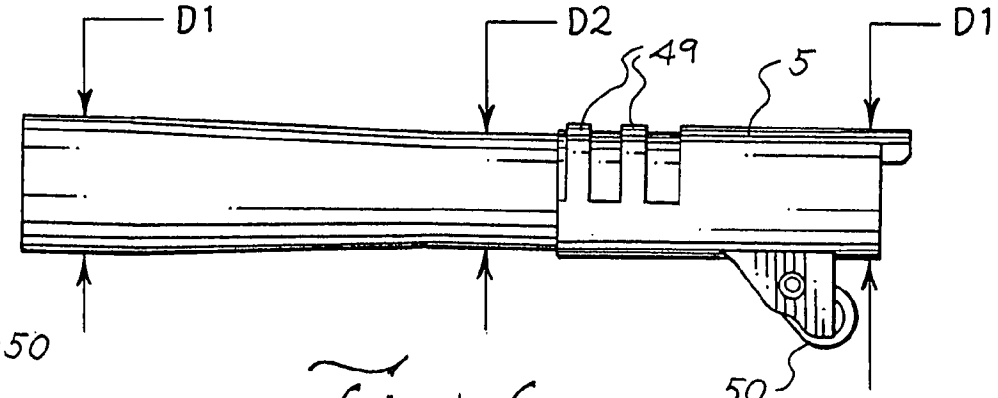
FIG. 6 is a side view of a bull barrel in accordance with the invention.
Figure 7:
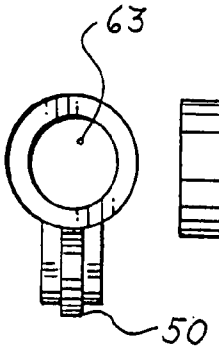
FIG. 7 is an end view of the barrel of FIG. 6.

FIG. 4 illustrates a partial cross-section of the slide 1 constructed in accordance with the invention. FIG. 5 illustrates an end view of the slide of FIG. 4. A side view of the bull barrel 5 is illustrated in FIG. 6 and an end view of the bull barrel is illustrated at FIG. 7. FIGS. 4 through 7 show an aspect of the invention wherein recoil and muzzle flip of the handgun of FIGS. 1 and 2A is minimized, without altering the classic design of the M1911 handgun or changing any significant external parts of the gun. Recoil and muzzle flip are reduced significantly by utilizing the relatively thick bull barrel as shown in FIG. 6 which has a significant front and rear diameter at D1 of 0.75 inch (1.905 cm). As is known in the art, this bull barrel is preferably made of 416R stainless steel. Of course, the barrel could also be made of carbon steel or of any other suitable material which provides the required increased mass for reducing recoil and muzzle flip and also can withstand the significant pressures associated with firing cartridges. As shown in FIG. 6, the diameter of the bull barrel 5 is reduced to a minimum diameter at D2 of 0.632 inch (1.605 cm) just ahead of the lugs 49 that are formed on the barrel 5.

In accordance with the invention, the bull barrel 5 of FIG. 6 is dimensioned to provide a maximum mass which can be retained within the slide 1. The barrel with the preferred dimensions of FIG. 6 is significantly thicker than a smaller diameter barrel, for example, with an external diameter at D1 of 0.700 inch (1.778 cm) or slightly less, which is typical for previous M1911-style handguns. As noted previously, the diameter of the bull barrel of FIG. 6 at D1 may be 0.75 inch (1.905 cm), although the invention is not limited to a bull barrel of this particular increased size.

The larger diameter bull barrel 5 would not fit within a typical M1911-style slide which heretofore has had external dimensions as shown in FIGS. 4 and 5, but much thicker sidewalls, for example with a thickness at D4 of 0.120 inch (0.305 cm) and a thickness at D5 of 0.110 inch (0.279 cm) for a typical slide (not shown). In accordance with the invention, as the bore 65 in the slide is increased, the walls of the slide 1 are made thinner, for example to a thickness at D5 of 0.085 inch (0.216 cm) and at D4 of 0.095 inch (0.241 cm) as shown in FIG. 5; this in order to reduce the mass of the slide and open up the interior of the slide to fit with the larger bull barrel 5 of FIG. 6.

Thus, as shown at FIG. 4, a slide 1 of typical external dimensions may be hollowed out until the wall thickness and associated mass of the forward portion of the slide is reduced to accommodate the corresponding increased mass and size of the larger bull barrel 5. Although the walls of the slide of FIG. 4 have decreased thickness, they retain sufficient strength to operate effectively in firing cartridges. Alternatively, a slide with the required thinner walls may be manufactured in the usual manner to fit the thicker and more massive bull barrel of FIG. 6. In either case, grooves 51 must be formed in the thinner walls of the slide 1 to accommodate associated lugs 49 of the bull barrel 5, so that the lugs engage the grooves when the slide and bull barrel are at their forward rest positions.

When the gun is fired, as a bullet is expelled from the case of a cartridge and moves down the barrel toward a target, the slide 1 and barrel 5 move backward together in response to the force of recoil for about 0.125 inch (0.318 cm) and thereafter a link 50 pulls down the barrel and disengages it from the slide so that the slide is free to move to its open battery position at which the spent cartridge casing is ejected by a mechanism (not shown) of known design. Thereafter the slide moves forward in response to the force of the return spring 35 and a fresh cartridge is stripped from the magazine 9 in a known manner and disposed in firing position in the breech of the gun as the slide moves forward. The cartridge is chambered after it passes over a feed-ramp (not shown) with a curvature sufficient to pass the cartridge without interference, and the slide and barrel return to their engaged forward rest position, awaiting the next trigger pull which again initiates the firing cycle.

FIG. 7 illustrates the end view of the muzzle of the bull barrel 5 of FIG. 6, with an internal bore 63 having a diameter sufficient to accommodate a .50 caliber bullet. In a preferred embodiment, the .50 caliber bore may have eight groove rifling with a 1:18 inch twist (not shown). Of course, other riflings and numbers of grooves could be used without departing from the scope of the invention.

FIG. 5 illustrates an end view of the slide 1 with an opening 65 that will accommodate the muzzle end of the bull barrel 5, and allow the slide to move for a distance with the barrel and for a greater distance in relation to the barrel. The slide also has an opening 67 that accommodates the reverse spring plug 39 of the spring assembly 34.

It should be appreciated that, in accordance with the invention, the total mass of the increased size bull barrel and the associated slide of less mass may be roughly the same as for the total mass of a slide and barrel for a typical M1911-style handgun. However, the redistribution of the reciprocating masses results in a significant perceived reduction in recoil and muzzle flip when the gun is fired.

Figure 8:
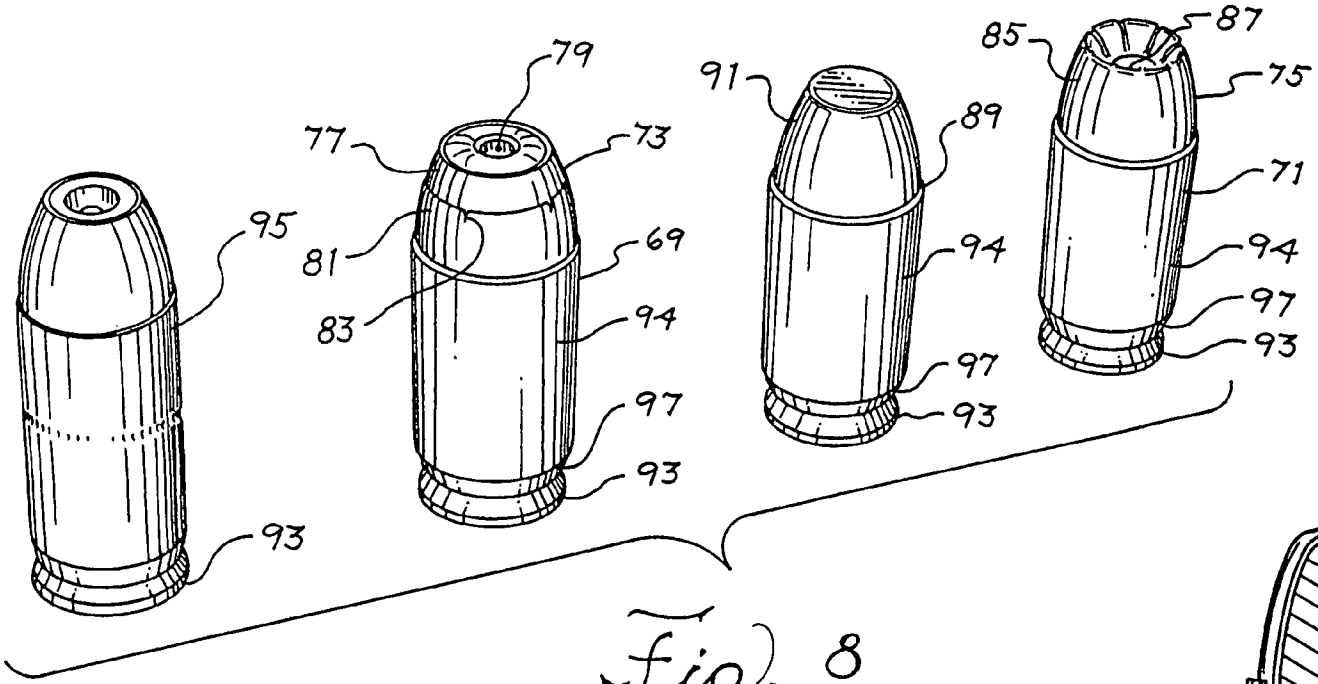
FIG. 8 is a perspective side view of a standard .45 ACP hollow point cartridge on the left, such as is known in the art, and three .50 caliber cartridges for use in a .50 caliber embodiment of the handgun of the invention.

In a preferred embodiment, the larger cross-section of the bull barrel of FIG. 6 can accommodate an internal bore sufficient to pass a .50 caliber bullet, while still retaining sufficient mass to reduce the recoil and muzzle flip associated with firing that bullet, to a level that would ordinarily be associated with the firing of a 45 ACP cartridge for a M1911-style handgun of typical design. FIG. 8 illustrates two centerfire .50 caliber cartridges 69, 71 that have hollow-point bullets 73, 75 which have enhanced expansion on impact. The cartridge 69 exposes the upper impact surface 77 of a lead bullet with a hollow point opening 79 and a partial copper jacket 81 having serrations or cuts 83 that facilitate expansion of the lead portion of the bullet on impact. Likewise, the cartridge 71 has a scored or serrated copper jacket 85 and an associated hollow point opening 87 which allow expansion of the underlying lead bullet. A centerfire .50 caliber cartridge 89 is also illustrated with a lead bullet that is totally encased with a full metal copper jacket 91.

All of the centerfire .50 caliber cartridges of FIG. 8 have rebated rims 93 that are formed in brass cases 94 to give the .50 caliber cartridges the same handgun handling characteristics as for a 45 ACP cartridge. The cases are from about 0.520 inch to 0.530 inch (1.32 cm to 1.35 cm) in diameter and the base rims are about 0.472 inch (1.20 cm) in diameter. A 45 ACP hollow point cartridge 95 is shown at the left of FIG. 8 to illustrate its relative thickness and length in association with the .50 caliber cartridges. The .45 ACP cartridge is about 0.06 inch (0.152 cm) less in diameter than the .50 caliber cartridges and has the same size rim 93. However, the .50 caliber cartridges have a relatively longer conically-shaped area 97 at their base. Also, the .50 caliber cartridges are about the same length as the 45 ACP cartridge, which is about 1.20-1.26 inches (3.05 cm-3.20 cm).

Figure 9:
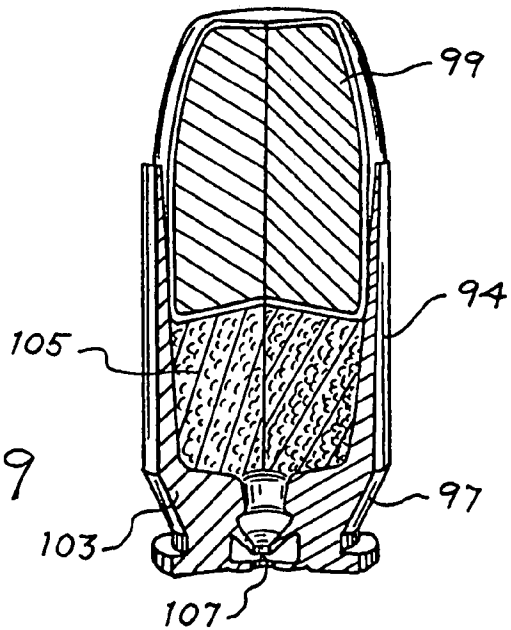
FIG. 9 is a side cross-sectional view of the full metal jacket .50 caliber cartridge illustrated in FIG. 8.

FIG. 9 illustrates a cross-sectional view of the full metal jacket cartridge 89 of FIG. 8. As shown in FIG. 9, a lead bullet 99 weighing, for example, 300 grains, is supported within the brass case 94 of the cartridge. A web portion 103 at the base of the cartridge is made relatively thick to withstand more than the expected internal bursting pressure that would result from ignition of a propellant 105, for example gun powder, that is disposed in a chamber below the bullet. A standard percussion-responsive primer 107 is disposed at the base of the cartridge in a known manner. In operation, the front edge of the case of the cartridge will abut against a shoulder formed at the breech end of the barrel 5 when the cartridge is stripped from a magazine and seated in the barrel chamber. Alternatively, if the base rim of the cartridge exceeds the diameter of the barrel chamber, the base rim will have an interference fit at the breech end of the barrel when the cartridge is chambered. In either case, when the trigger of the gun is pulled, a firing pin (not shown) hits the primer 107 at the base of the cartridge and the primer ignites and explodes the propellant 105 which then propels a bullet from the case 94, and the case is thereafter automatically extracted and expelled from the handgun as previously described. In general, a .50caliber bullet will form a relatively larger wound channel than will a 45 ACP bullet. For that reason, the .50 caliber bullet should have greater stopping power and incapacitating effect than a .45 caliber bullet.

The .50 caliber cartridges of FIGS. 8 and 9 have been tested with propellants such as TITE GROUP® provided by the Hodgdon Co. and HERCO® provided by Alliant Power Co. and with loads that can propel 300 grain bullets at muzzle velocities of from 700 to about 900 fps, which is very adequate for target shooting, hunting or self defense. It has been found that 5 grains of TITE GROUPS® will provide a muzzle velocity of from 700 to 725 fps in an uncompressed load for a 300 grain bullet. A muzzle velocity of from 875 to 900 fps will be provided for a 300 grain bullet with 8 grains of uncompressed HERCO®.

It should be appreciated that many designs for .50 caliber cartridges could be employed with the handgun of the invention, without departing from the invention. For example, the handgun of the invention has been used with cartridges having 300 grain Rainier JFP, 300 grain Speer TMJ, 240 grain lead semi-wadcutter, 300 grain Speer Gold Dot HP, and 300 grain copper clad FP bullets of various designs. Also, sintered bullets of known designs could be used with the described cartridge housings without departing from the invention and propellant loads sufficient to provide from 600-1000 fps muzzle velocities could be used as required. Although the described bullets, propellants and loads have been found suitable for .50 caliber operation with the handgun of the invention, .50 caliber bullets, propellants and loads of other manufacturers could be used as well.

Figure 10:
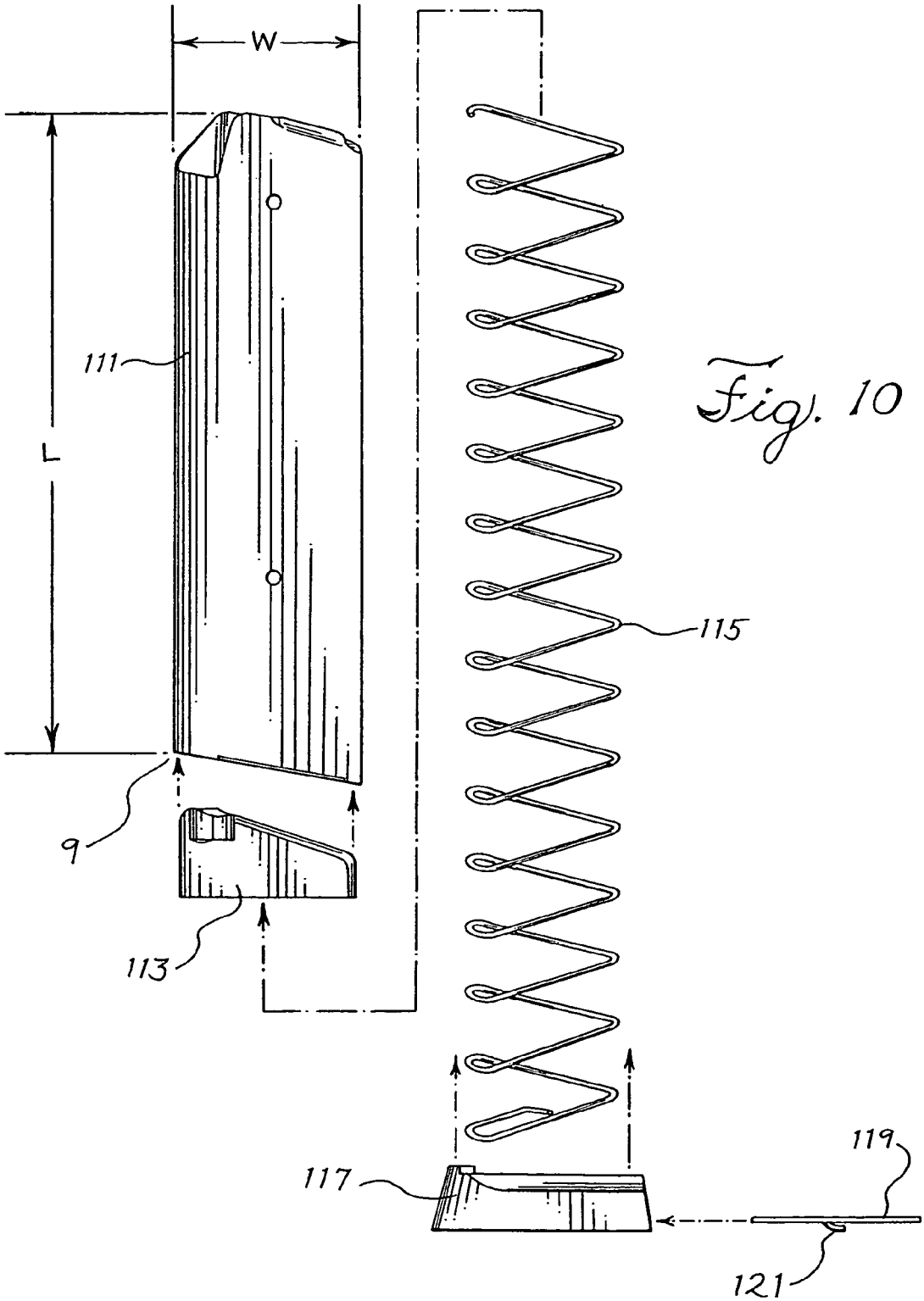
FIG. 10 is an exploded perspective side view of a cartridge magazine and associated parts in accordance with the invention.

FIG. 10 illustrates an exploded side view of a magazine that may be used with the handgun of the invention. As shown in FIG. 10, a body of the magazine 111 may be made of heavy-gauge heat-treated stainless steel and engaged in sliding relation with an associated follower 113 that is preferably made of a nylon polymer that is self-lubricating, so that it slides with reduced friction within the body of the magazine. A magazine spring 115 made of, for example chrome-silicon, has been obtained from Integrated Systems Management Inc. of Carthage, Indiana, with an extra long length and a powerful bias force. In making the magazine, one coil is clipped from the spring and the spring is then compressed to fully fill the magazine. This spring is sufficient to move the follower 113 in association with a single stack of seven .50 caliber cartridges, and reliably dispense the cartridges within the handgun with substantial resiliency and life. A base 117 made of, for example steel, aluminum or a polymer, engages the edge at the bottom wall of the magazine 111 in sliding relation and holds a retainer plate 119 pressed against the associated end of the spring 115. The plate 119 has a button 121 that extends through a hole (not shown) drilled in the base 117. When all parts are engaged, the spring-biased engagement of the button 121 within the hole in the base 117 retains all parts together. If the button 121 is pressed inwardly, the plate 119 disengages from the base and allows the base to be disengaged and all parts to be removed.

Figure 11:
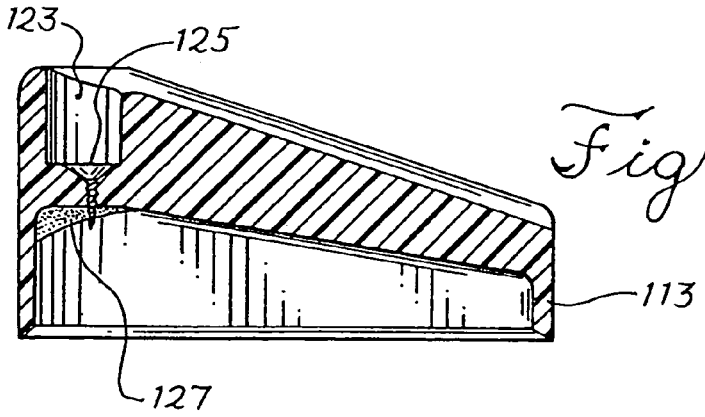
FIG. 11 is a side view, in section, of the follower element of the magazine of FIG. 10.

FIG. 11 shows a cross-sectional view of the polymer follower 113. In operation, this follower presses against a stack of bullets and spring-biases the bullets for individual loading into the handgun by a known extractor mechanism (not shown). The follower has an indentation 123 that is formed to receive a slide blocking element (not shown) that is well known and that is used to engage the follower when it reaches the top of the magazine and dispenses the last cartridge into the gun. At that point, the blocking element engages the follower within the indentation 123 and causes the slide of the gun to be locked in a rearmost position when the final cartridge of a magazine has been fired and the magazine is empty. The gun is therefore held in an open battery position and is ready to receive a freshly loaded magazine.

The wear characteristics of the follower are enhanced by a metal insert, for example a steel screw 125 with a hex head that is screwed into the polymer to provide metal-reinforcement at the base of the indentation 123. Excessive wear of the surface at the base of the indentation is thereby avoided and the life of the follower and the magazine are increased. A drop 127 of epoxy or other sealing material such as LOCTITE® is applied to seal the tip of the screw 125. The follower could also be molded with an embedded metal plate or other metal insert at the base of the indentation 123 to provide the desirable favorable wear characteristics.

Figure 12:
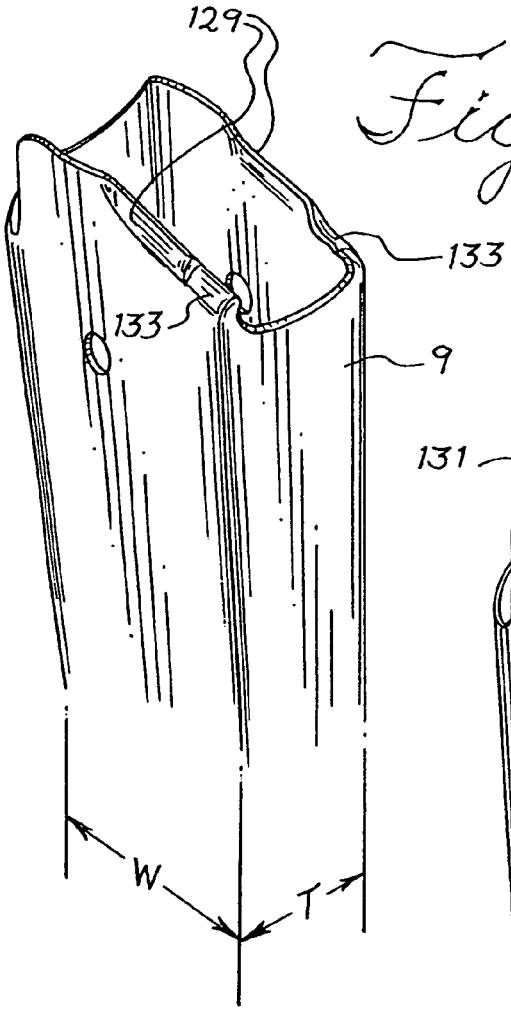
FIG. 12 is a partial perspective view of the top portion of the magazine of FIG. 10 with crimped feed lips for retaining a rebated rim .50 caliber cartridge.
Figure 13:
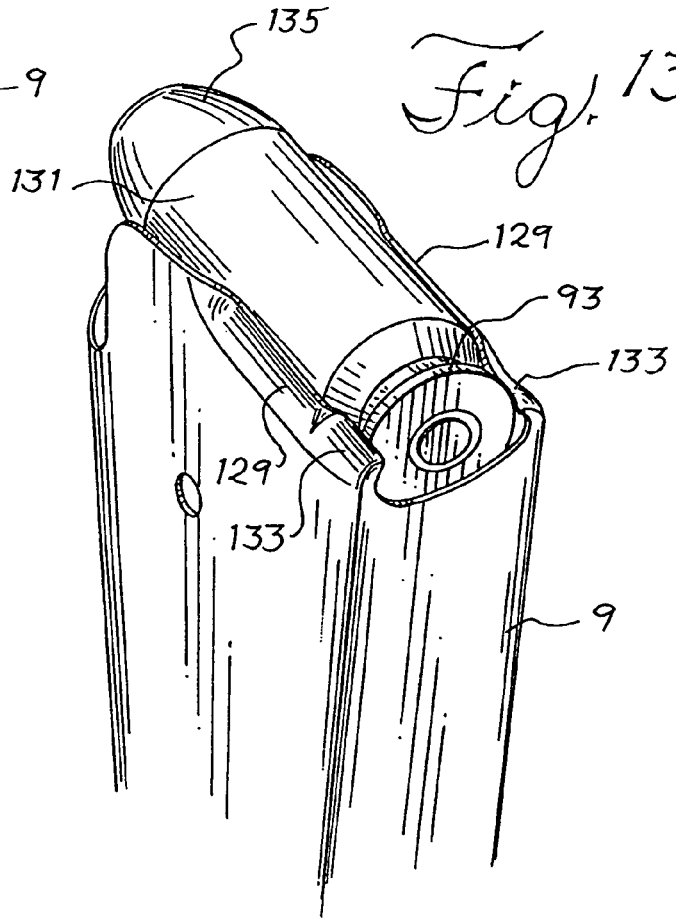
FIG. 13 is a partial perspective view of the magazine of FIG. 12, with a rebated rim .50 caliber cartridge engaged with feed lips of the magazine.

FIG. 12 illustrates the top-rear of the magazine 9 of FIG. 10. As shown in FIG. 12, the metal walls of the magazine are crimped or pinched to form lips in two cartridge-handling areas for guiding a .50 caliber rebated rim cartridge during a feed cycle of the handgun. The first of these areas 129 is shaped to engage the outer case of a cartridge that is held by the magazine. FIG. 13 shows the magazine of FIG. 12 with a .50 caliber cartridge engaged. As shown in FIGS. 12 and 13, the crimped or pinched area 129 engages the outer wall 131 of the cartridge so that the cartridge will slide forward in aligned movement as it is stripped from the magazine and loaded into the gun. A second crimped or pinched cartridge handling area 133 is shown engaged with the rim 93 of the .50 caliber cartridge as the cartridge is initially moved out of the magazine. For initial travel of the cartridge over about 0.188 inch (0.478 cm), the rim 93 engages lips formed by the crimped or pinched area 133, so that the front nose 135 of the cartridge does not dive or move downward as the cartridge moves forward into engagement with the handgun.

Nose-diving of cartridges is associated with jamming malfunctions. With the relatively thick and short .50 caliber cartridge of the invention, nose-diving would be a particularly serious problem, and this problem is avoided by use of the feed lips 133 in association with the rebated rim 93 of the cartridge. After the cartridge moves past the initial 0.188 inch (0.478) cm of travel, it is sufficiently engaged with the handgun so that nose-diving is no longer a problem, accordingly, the cartridge handling areas 129 are provided to align and guide the sides 131 of the cartridge as it moves further into the gun to complete loading of the gun.

Though illustrated here on a .50 caliber rebated rim cartridge, the principle of utilizing crimped feed lips to guide a rebated rim of a cartridge and thereby avoid nose-diving of the cartridge, will work equally well on cartridges of different calibers, as long as they are of rebated rim design. Accordingly, the cartridge-guiding invention for the magazine of FIGS. 10-13 can be used with any particular caliber of cartridge having a rebated rim, or any type of firearm, for example a handgun or rifle using a rebated rim cartridge. Also, the reinforced magazine follower of the invention may be used with any magazine and caliber cartridge, with or without a rebated rim.

Figure 14:
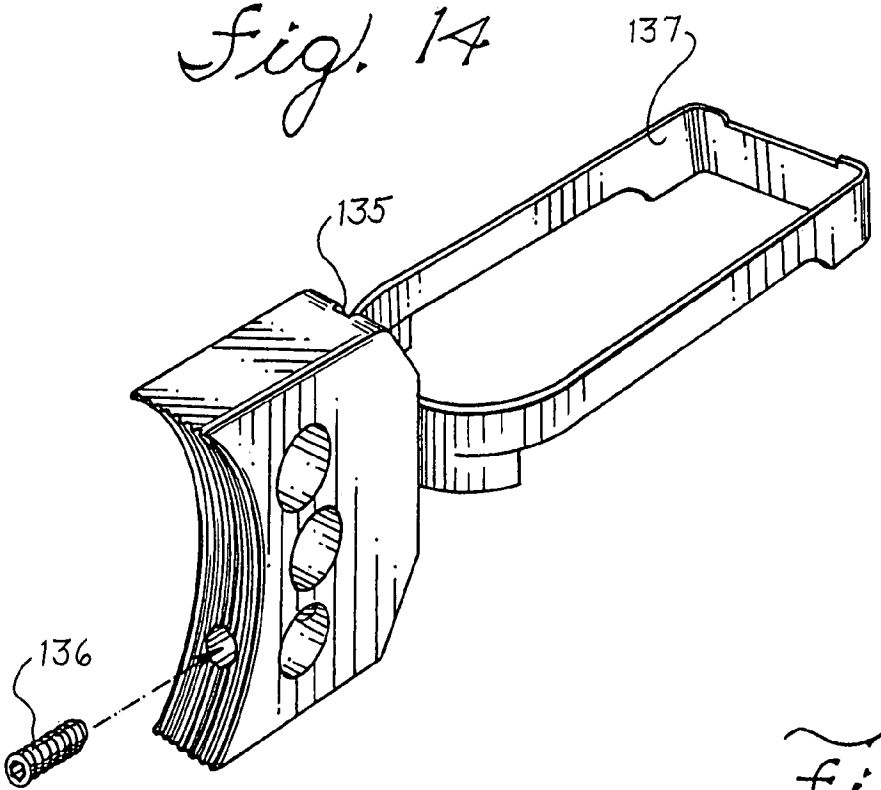
FIG. 14 is a perspective view of a trigger for the handgun of FIG. 1, with an expanded bow to accommodate the increased thickness of the magazine of FIG. 10.

FIG. 14 illustrates a skeletonized aluminum trigger 135 with a trigger bow 137 that is dimensioned about 0.06 inch (0.152 cm) larger in width to receive the oversized magazine 9 in spaced, sliding relation. The bow is disposed in associated grooves (not shown) formed to provide a "trigger track" in the inner wall of the magazine well of the handgun. Also, a screw 136 is provided to adjust the over-travel of the trigger in a known manner.

It should be appreciated with reference to FIGS. 11 and 12 that the dimensions of the body 111 of the magazine accommodate .50 caliber ammunition. Thus, with reference to FIG. 12, the thickness T of 0.6 inch (1.52 cm) of the magazine has been increased by about 0.06 inch from a standard thickness in order to retain .50 caliber cartridges. The width W of about 1.37 inches (3.48 cm) and length L of about 5 inches (12.7 cm) for the magazine of FIGS. 10 and 12 does not change from what would be typical for a standard M1911-style handgun.

With reference to FIG. 1, the grip portion 3 of the frame accommodates the increased thickness of the magazine 9, by increasing the corresponding internal thickness dimension of the magazine well, for example by hollowing out the magazine well by milling, broaching or by EDM machining. It has been found that when the magazine well is hollowed out, the thickness of the walls at the well is reduced to the point that the slide guide rails at the top of the frame 53 adjacent the well, as shown in FIG. 3, must be removed. This does not adversely affect the operation of the slide 1, which is adequately supported by the remaining portions of the rails. Also, the increased size feed ramp associated with the .50 caliber cartridge and the required material removal in interior areas, is accomplished without changing the typical exterior dimensions of the M1911-style grip portion of the frame. The bottom end of the magazine well may also be beveled to facilitate insertion of the magazine. Thus, in accordance with the invention, the external size, shape and appearance of the handgun will not change. Also, the weight of the handgun that is disclosed herein will be about 38 ounces, which is within the typical weight range for M1911 handguns of standard design.

A .50 caliber handgun manufactured and operating as previously described, will have the same classic appearance as a typical M1911-style handgun, but will fire .50 caliber cartridges with increased stopping power, without a perceived recoil or muzzle flip greater than would be expected from a standard M1911 handgun shooting smaller 45 ACP ammunition. The handgun of the invention is also versatile, because it may be easily modified to shoot smaller caliber bullets such as .45 ACP, .38 Super, .40 S&W, and 9 mm.

If, for example, .45 ACP cartridges are desired to be fired from a handgun designed according to the invention, all that is required is that the 0.75 inch (1.905 cm) diameter bull barrel with a .50 bore be removed and exchanged with a bull barrel of the same external dimensions having a smaller bore to accommodate the bullets of .45 ACP cartridges. Since the bore in this gun is smaller, there will be an even greater mass for the barrel and correspondingly less recoil and muzzle flip for .45 ACP ammunition.

Of course, the magazine must also be altered to accommodate .45 ACP ammunition. This is done by using the magazine 138 of FIG. 15 having the same dimensions as was previously described for .50 caliber ammunition, but with a design that is adapted for use with .50 caliber and smaller cartridges. This magazine 138 does not require the pinched rear feed lips, which were shown in FIGS. 12 and 13. Instead, the magazine 138 has a uniformly shaped cartridge handling area 139 which exhibits feed lips dimensioned and formed to receive and dispense .45 ACP cartridges. Thus, the larger size magazine for .50 caliber cartridges has been easily modified to accommodate .45 ACP cartridges, without requiring any other change in the magazine, except possibly to provide a magazine spring of reduced force for the smaller cartridges. The magazine of FIG. 15 can therefore hold .45 ACP cartridges in stacked relation and can be engaged in the magazine well of the M1911-style handgun of the invention in the same manner as was done for the oversize .50 caliber magazines.

Figure 15:
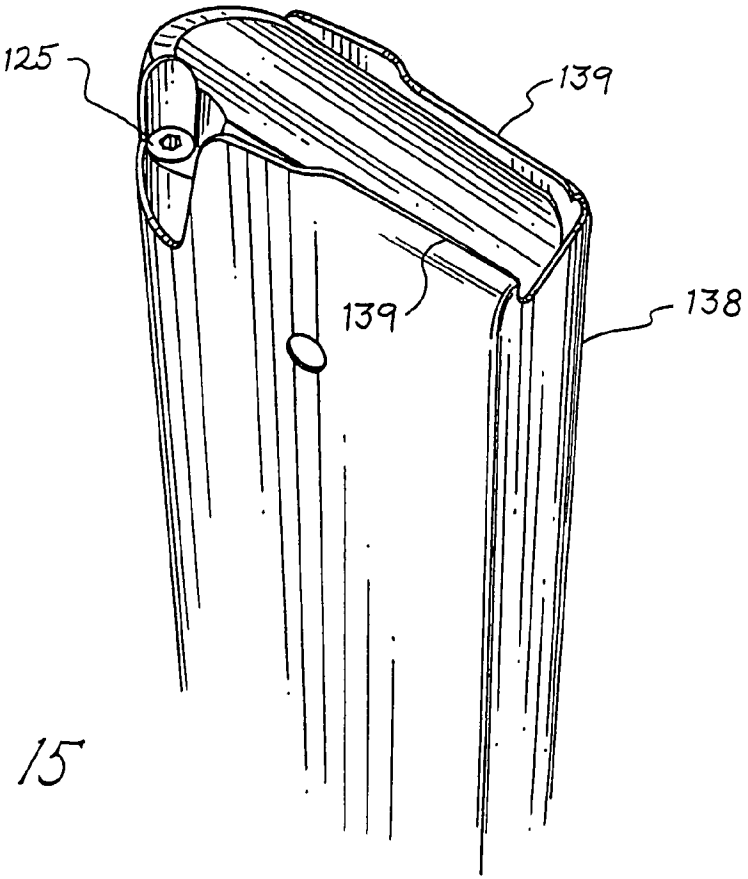
FIG. 15 is a partial perspective view of the top portion of a magazine with the feed lips formed to accommodate cartridges without the rebated rim design, such as .45 ACP, .40 S&W, .38 Super and 9 mm.

Likewise, the oversize magazine of FIG. 15 can be made with or without crimped or pinched cartridge handling areas 139, to accommodate .40 S&W, .38 Super, 9 mm, or any cartridges of .50 caliber or less, preferably without rebated rims. If .50 caliber or any other caliber cartridges with rebated rims are used with the magazine of FIG. 15, there will be some undesirable nose-diving in feeding such cartridges, but the magazine could still operate with the cartridges, albeit in a manner that is not optimum. If the magazine of FIG. 15 operates with cartridges of less than .50 caliber, bull barrels with bores sized to these smaller cartridges will be required. Also, a spacer (not shown) may be required within the magazine to accommodate short cartridges, as is known in the handgun art. And when smaller caliber ammunition and associated smaller bores are used for the massive bull barrel, there will be even more mass for the barrel and a greater proportionate reduction in perceived recoil and muzzle flip. Accordingly, the operational characteristics of the handgun will improve as the caliber of the ammunition is reduced.

The handgun of the invention may also accommodate bullets of less than .50 caliber by use of .50 caliber cartridge casings that are "necked down" at their front end to receive smaller caliber bullets, for example 0.45, 0.40, 0.38, 9 mm or any size bullet that can be fitted into the reduced diameter of the open front of the casing. The casings would retain the rebated .45 ACP rim and would operate with the smaller caliber bullets as previously described for the .50 caliber bullet. That is, the magazine of FIGS. 10, 11 and 12 would be used and the .50 caliber casing with a smaller caliber bullet would be handled by the mechanism of the handgun in the same manner as was previously described for .50 caliber cartridges. The relatively large .50 caliber casing would have increased volume to retain substantial loads of propellant for the smaller caliber bullets. For some smaller caliber bullets, muzzle velocities in excess of 2,000 fps could be obtained without damaging the frame or other parts of the gun. The handgun of the invention could therefore be easily modified to shoot any such reduced caliber bullets with .50 caliber casings by merely changing the barrel to one with the same external dimensions as the .50 caliber barrel, and with an internal bore sized to accommodate the selected reduced caliber of the bullet.

A handgun according to the invention therefore provides a very versatile operation in that it can easily accommodate different calibers of ammunition and for any such caliber, the perceived recoil and muzzle flip is reduced beyond what would typically be expected. The handgun of the invention also has the substantial advantage that it may operate comfortably with .50 caliber ammunition, which has heretofore not been possible for handguns having a classic M1911 design.

Although particular materials, dimensions of parts, and types of parts have been disclosed herein, it should be appreciated that other known materials, dimensions, and types of parts may also be used without departing from the stated principles of the invention. For example, the invention is not limited to use of the disclosed bull barrel. Another, even more massive style of bull barrel may be used with improved results. This second type of bull barrel has the conical, tapered portion only at the top of the barrel to accommodate the up-and-down movement of the barrel when firing. The bottom half of this barrel is not tapered, but extends at the maximum diameter from the muzzle to the back of the barrel at the chamber, thus providing more mass for the barrel. If this alternative type of bull barrel is used, the slide will still have to be hollowed out to accommodate the shape of this barrel. Also, a relatively massive bushing barrel of robust dimensions could be used, with no significant taper to the barrel and with a correspondingly shaped and hollowed out slide, without departing from the invention. And, the perceived reduced recoil and muzzle flip could be obtained in the described manner and in accordance with the invention for handguns that have a M1911-style appearance and use a cam-operated system rather than a link to provide the required up-and-down movement of the barrel.

The invention could also be implemented for M1911-style handguns that do not use a shock buffer or any internal or external parts that are incidental to the cartridge handling and firing mechanisms of classic M1911 handguns. Moreover, the perceived reduced recoil and muzzle flip can be obtained as described for the invention in M1911-style handguns that have ejectors, extractors and breech mechanisms sized to accommodate cartridges of any caliber, for example cartridges with calibers less than .45 ACP. In any such weapons, the redistribution of mass from the slide to the barrel can be achieved in accordance with the invention, and cartridges of any desired caliber could be used in the manner described herein by applying the principles of the invention. Thus, for example, a kit consisting of an assembly having a matched barrel and slide with advantageously redistributed mass in accordance with the invention, could be provided for retrofit in any M1911-style handgun to modify that handgun for operation with reduced recoil and muzzle flip with standard or propriety cartridges sized for that gun.

Also, examples herein given with respect to calibers of 0.45, 0.40, 0.38 and 9 mm are not restrictive, but are intended to exemplify how the invention can operate for any cartridges and bullets of less than .50 calibers. It is therefore intended that the foregoing detailed description be regarded as illustrative rather than limiting, and that it be understood that the following claims, including all equivalents, are intended to define the full scope of this invention.

The invention claimed is:

1. An improved magazine for rifles and handguns which fire cartridges of a selected caliber having a cylindrical body portion of one diameter and a rebated base rim which is formed by a disk with a peripheral edge of lesser diameter than said one diameter, the magazine having feed lips oriented to run along the length of each cartridge as it is dispensed from the magazine, for engaging said cylindrical body portion and said peripheral edge of said base rim to stabilize the cartridge and prevent nose-diving of the cartridge as it is fed from the magazine to the rifle or handgun.

2. The improved magazine of claim 1, including a chrome-silicon spring for biasing one or more of said cartridges of selected caliber within the magazine upward for dispensing from the top of the magazine.

3. The improved magazine of claim 1, including a spring-biased follower made of polymer and having an indented opening supporting a metal insert.

4. The improved magazine of claim 3, wherein said metal insert is the top of a screw secured in the indented opening of the follower.

5. The improved magazine of claim 4, wherein said screw has a pointed end which extends from the follower and is covered with a sealant.

6. The improved magazine of claim 1, wherein the selected caliber is .50 and said rebated base rim is dimensioned to match the base rim of a .45 ACP cartridge.

7. The improved magazine of claim 1, wherein said cartridge comprises:

a bullet of .50 caliber or less;

a .50 caliber cartridge case for supporting said bullet;

an ignitable propellant and a percussion-responsive primer disposed in said cartridge case;

the cartridge having approximately the same length as a .45 ACP cartridge; and the case having a base web portion of sufficient thickness to withstand more bursting pressure than can be generated by said propellant, and a rebated base rim dimensioned the same as for a .45 ACP cartridge.

8. The improved magazine of claim 7, including a full metal jacket containing said bullet.

9. The improved magazine of claim 7, wherein said bullet is shaped in a hollow-point configuration to enhance expansion on impact.

10. The improved magazine of claim 1, wherein said feed lips are crimped for engaging the peripheral edge of said rebated base rim for a predetermined distance as the cartridge is fed from the magazine and for engaging said body portion until the cartridge is fed from the magazine.

11. A magazine for retaining and dispensing cartridges of a selected caliber for firearms that include a reciprocating slide and a blocking element for holding the slide in an open battery position when all cartridges are dispensed, comprising:

a housing for holding one or more cartridges;

a top portion of said housing having crimped feed lips for successively dispensing said one or more cartridges;

a polymer follower within the housing for biasing said one or more cartridges for dispensing, said follower having an indentation with a metal plate for receiving said blocking element only when the slide is in the open battery position and all cartridges are dispensed and for abutting the blocking element to selectively block the slide in the open battery position; and said feed lips stabilizing the forward movement of each cartridge for a predefined distance as it is dispensed.

12. The magazine of claim 11, wherein said plate is formed by the head of a screw that engages said follower.

13. The magazine of claim 11, wherein said cartridges are dimensioned to carry bullets of .50 caliber or less and have a rebated base rim.

14. The magazine of claim 11, wherein said cartridges have .50 caliber cases, bullets of .50 caliber or less, and rebated base rims dimensioned the same as for a .45 ACP cartridge.

15. A magazine for a handgun or rifle, comprising:

a housing for retaining and dispensing one or more cartridges, each cartridge having a cylindrical case and a rebated base rim element with a peripheral edge;

a follower disposed in said housing for biasing one or more of said cartridges within the housing; and cartridge feed lips positioned along the length of the cartridge and dimensioned to engage the peripheral edge of the rebated base rim element of each cartridge to prevent nose-diving as the cartridge is dispensed from the magazine an initial predetermined distance and engage said case to maintain each cartridge in an axially aligned orientation as it is dispensed.

16. The magazine of claim 15, wherein said follower is made of polymer and has an indented portion with a metal insert.

17. The magazine of claim 15, wherein a rear portion of said cartridge feed lips are crimped to engage said peripheral edge of said rebated base rim and axially align the associated cartridge over said initial predetermined distance as the cartridge is dispensed.

18. The magazine of claim 17, wherein a front portion of said cartridge feed lips are crimped to engage said case and axially align the associated cartridge as it is dispensed.

19. The magazine of claim 18, wherein said cartridges have a .50 caliber case, bullets of .50 caliber or less, and rebated base rims dimensioned the same as for a .45 ACP cartridge.

20. The magazine of claim 15, wherein said cartridges have a .50 caliber case, bullets of .50 caliber or less, and rebated base rims dimensioned the same as for a .45 ACP cartridge.

21. A method for providing an improved magazine for dispensing cartridges of a rifle or handgun, the cartridges having a rebated base rim and a housing of different diameters, the steps comprising:

Forming a magazine housing having an open top portion, a closed bottom portion, and side walls;

Defining feed lips laterally spaced at said open top portion and oriented along the length of dispensed cartridges;

Crimping said feed lips to a different degree for at least two different areas of said top portion to engage said different diameters of the cartridge;

Using said crimped feed lips to engage only peripheral side portions of said cartridges along the length of said cartridges; and Dispensing cartridges from said housing in an axially aligned orientation.

* * * * *